US006941698B2

(12) United States Patent
Telles

(10) Patent No.: US 6,941,698 B2
(45) Date of Patent: Sep. 13, 2005

(54) OBJECT HANGER

(76) Inventor: Matthew Telles, 55-601 Naniloa Loop, Laie, HI (US) 96762

( * ) Notice: Subject to any disclaimer, the term of this patent is extended or adjusted under 35 U.S.C. 154(b) by 0 days.

(21) Appl. No.: 10/706,853

(22) Filed: Nov. 12, 2003

(65) Prior Publication Data

US 2005/0097817 A1 May 12, 2005

(51) Int. Cl.[7] ..... A01G 9/02; A47G 7/02

(52) U.S. Cl. ..... 47/67; 83/44; 83/66.6; 248/318; 248/320; 248/327; 248/328; 211/85.23; 211/118; 211/117

(58) Field of Search ..... 248/318, 320, 248/327, 328, 323, 341, 317, 27.8; 47/66.6, 47/67, 66.7, 83, 39, 41.11, 65.5, 44; D6/556, D6/513; D11/143; 294/74; 119/728; 211/85.23, 211/118, 117

(56) References Cited

U.S. PATENT DOCUMENTS 941,448 A * 11/1909 Haglund ..... 248/318
2,532,306 A * 12/1950 Herbert ..... 294/150
3,081,058 A * 3/1963 De Vries et al. ..... 248/318
D228,360 S * 9/1973 Sunshine ..... D11/145
4,057,210 A * 11/1977 Wellman ..... 248/318
4,101,109 A * 7/1978 Edwards ..... 248/317
4,227,669 A * 10/1980 McInnis ..... 248/317
4,349,172 A * 9/1982 Banks, Jr. ..... 248/318
4,506,475 A * 3/1985 Elliott ..... 47/67
4,520,979 A * 6/1985 McInnis ..... 248/323
4,956,937 A 9/1990 Haddox
D432,943 S * 10/2000 Schottin ..... D11/143
6,540,189 B2 4/2003 Hsiang

FOREIGN PATENT DOCUMENTS

FR 2659213 A1 * 9/1991 ..... A47G 7/02

* cited by examiner

*Primary Examiner*—Peter M. Poon
*Assistant Examiner*—Andrea M. Valenti

(57) ABSTRACT

In accordance with the present invention there is provided a hanger adapted for retaining and hanging objects, the hanger including a ring, at least two upper flexible members having first and second ends, wherein each member is received through an aperture of the ring, the flexible members defining an upper portion of the hanger. A lower hanger portion, the lower hanger portion including of at least two lower flexible members having first and second ends, wherein each of the two members are fixedly attached to each other at a mid point, the first and second ends including an adjustment device configured to receive the second ends of the upper flexible members; and a flexible retaining ring, the flexible retaining ring configured to receive the first and second ends of the lower flexible members, wherein the retaining ring is configured to retain the ends of the lower flexible members at a distance from one another and to securely retain an object such as a potted plant in the lower assembly.

19 Claims, 4 Drawing Sheets

OBJECT HANGER

TECHNICAL FIELD

The present invention is related to a device for hanging objects; more particularly the present invention is a hanger having flexible members having adjustable length, whereby the hanger can be configured to securely retain and hang objects of various size and shape.

BACKGROUND OF THE INVENTION

Hangers for objects such as potted plants are well know in the art, in particular, many of these hangars are configured to hold at least one potted plant suspended from a fixed support such as a screw or bolt installed in a ceiling or wall. In particular, many of these hangers utilize flexible support members such as ropes, wire rope, chains, or similar materials, wherein the flexible support members are coupled to a rigid member, the rigid member configured to support a potted plant thereon. Many times these plant hangers are designed so that a user may hang a plant outside on a balcony or porch where the plant and hanger will be subject to forces of nature such as wind, or in places that are prone to earthquakes, ground movement or vibrations. Even through many of these plant hangers are advertised as being suitable for outdoor use, many are not. Many times, the potted plant is only retained within a mesh of straps or suspended on a platform which is suspended from a plurality of straps, the potted plant is placed within the straps and the straps are arranged to retain the plant. A problem with this type of arrangement is that each of the straps are allowed to move independent of one another, thus if any one strap moves to far, the potted plant may fall from the hanger. Many attempts have been made to address this problem. An example of such a hanger assembly can be seen in U.S. Pat. No. 6,540,189, there is show a plant hanger having a top plate, a bottom plate and two adjustable belts disposed between the two. The top plate further including a hanging means to suspend the assembly therefrom. A shortcoming of a hanger of this type is that the potted plant is only retained within the hanger by friction forces of the belts on the pot of the plant. This is undesirable for many reasons, specifically, this is undesirable because in the event that the lower plate is jarred or bumped, the potted plant may shift on the lower plate thereby applying a force to the belts holding the potted plant on the lower plate in which the belts may spread due to the applied force and the potted plant may fall from it's suspended position. This is undesirable because the falling plant may injure a person standing nearby.

Another example of a potted plant holder can be seen in U.S. Pat. No. 4,956,937, where there is shown and described a potted plant holder having a plurality of flexible members, wherein the members may be adjusted to adjust the height between the fixed support and the potted plant. As shown in U.S. '937, the hanger utilizes a plurality of flexible members to retain the potted plant, wherein each of the flexible members are capable of independent movement. Therefore, in the event of a windstorm or an external force, the potted plant may fall from the hanger, potentially causing injury to a nearby bystander.

Shortcomings of current hanger designs is that each of the flexible members that are intended to retain a potted plant are allowed to move independent of each other. By allowing each of the members to move independently there is the possibility that at least one of the members may move enough thereby allowing the potted plant to fall from the hanger assembly. Thus, there is a need for an improved hanger.

These and other objects, advantages, and features of the invention will become apparent to those persons skilled in the art upon reading the details of the methods and systems of the present invention which are more fully described below.

SUMMARY OF THE INVENTION

In accordance with the present invention there is provided a hanger assembly configured to retain/hold and/or display items such as potted plants, speakers, coolers, or similar items. The hanger assembly includes a plurality of upper flexible members attached to a ring, wherein the ring may be used to hang the hanger from a fixed support. A lower container support assembly is detachably attached to the upper flexible members, wherein the lower container support assembly is configured to retain articles such as those described above.

In accordance with the present invention there is provided a hanger adapted for retaining and hanging objects, the hanger including a ring, at least two upper flexible members having first and second ends, wherein each member is received through an aperture of the ring, the flexible members defining an upper portion of the hanger, a lower hanger portion, the lower hanger portion including of at least two lower flexible members having first and second ends, wherein each of the two members are fixedly attached to each other at a mid point, the first and second ends including an adjustment means configured to receive the second ends of the upper flexible members; and a flexible retaining ring, the flexible retaining ring configured to receive said first and second ends of the lower flexible members, wherein the retaining ring is configured to retain the ends of the lower flexible members at a distance from one another.

In accordance with another embodiment of the present invention there is provided a hanger for suspending a plant container and the like from a fixed support, the hanger including a ring and an upper portion, the upper portion including at least two flexible upper members having first and second ends defining a length, wherein the flexible members are disposed through an aperture of the ring wherein equal lengths of the members are disposed on each side of the ring. The hanger further including a container supporting member, the container supporting member including at least two flexible members having first and second ends, each fixedly attached to one another about a midpoint and including connection means at each end, wherein the connection means are adapted to receive the first and second end of the upper members, wherein the container supporting member further including a third flexible support member, wherein the third flexible member is configured to be fixedly attached adjacent to the first and second ends of the flexible members comprising the container supporting member.

BRIEF DESCRIPTION OF THE FIGURES

To facilitate understanding, the same reference numerals have been used (where practical) to designate similar elements that are common to the Figures. Some such numbering has, however, been omitted for the sake of drawing clarity.

DETAILED DESCRIPTION OF THE PREFERRED EMBODIMENTS

Figure 1:
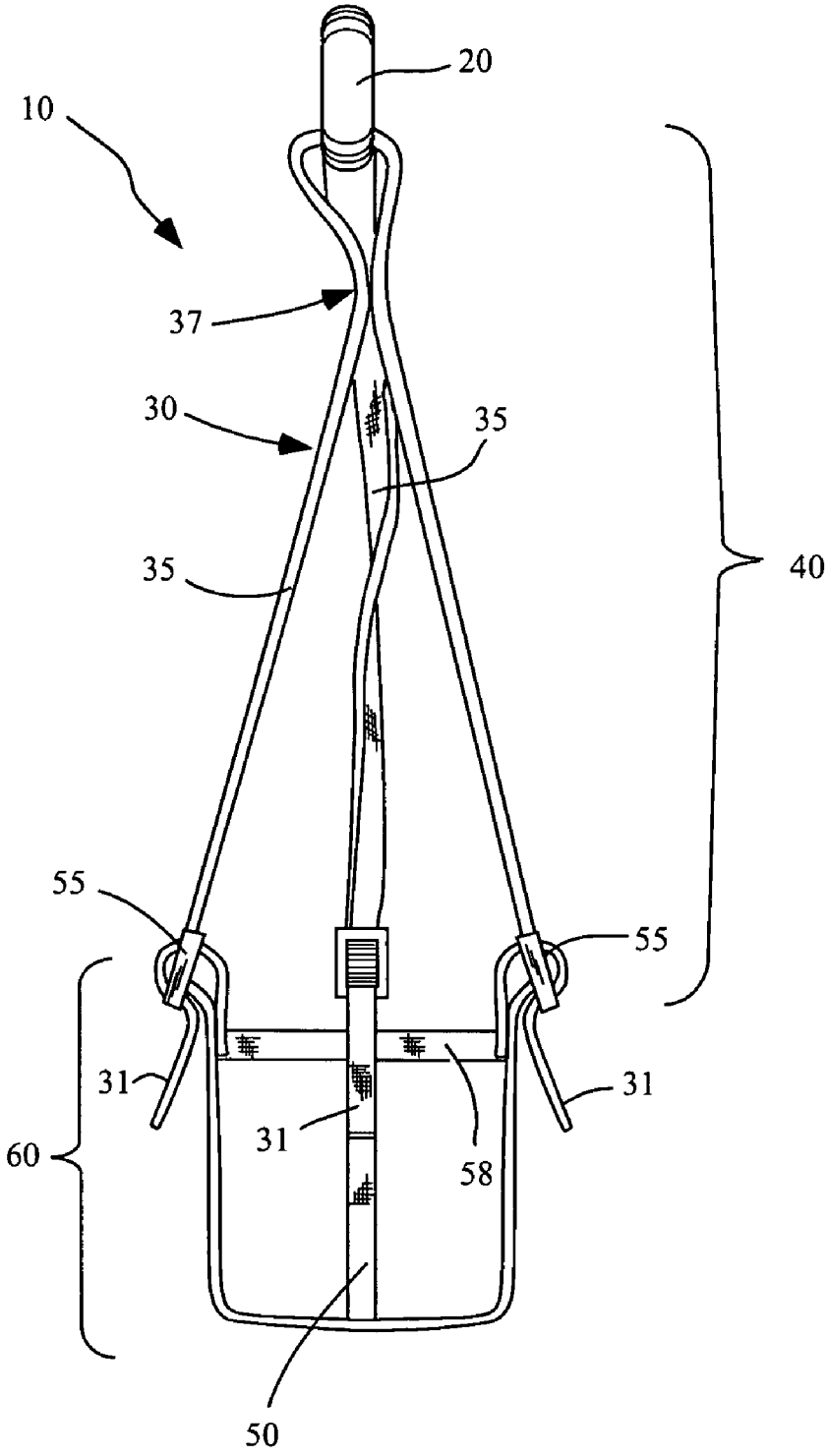
FIG. 1 is a perspective of an exemplary embodiment of the hanger in accordance with the present invention.

Before the present invention is described in such detail, it is to be understood that this invention is not limited to particular variations set forth herein as various changes or modifications may be made to the invention described and equivalents may be substituted without departing from the true spirit and scope of the invention. In addition, many modifications may be made to adapt a particular situation, material, composition of matter, process, process act(s) or step(s) to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

Reference to a singular item, includes the possibility that there are plural of the same items present. More specifically, as used herein and in the appended claims, the singular forms "a," "and," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Last, it is to be appreciated that unless defined otherwise, all technical and scientific terms used herein have the same meaning as commonly understood by one of ordinary skill in the art to which this invention belongs.

In accordance with the present invention there is provided a hanger assembly configured to retain/hold and/or display items such as potted plants, speakers, coolers, or similar items. The hanger assembly includes a plurality of upper flexible members attached to a ring, wherein the ring may be used to hang the hanger from a fixed support. A lower container support assembly is detachably attached to the upper flexible members, wherein the lower container support assembly is configured to retain articles such as those described above.

Referring now to FIG. 1, there is shown an exemplary embodiment of a hanger assembly in accordance with the present invention. As show in FIG. 1, the hanger assembly 10 includes an upper/support assembly 40 and a lower assembly 60 forming a cradle, wherein the upper and lower assemblies combined form the entire hanger assembly 10.

The upper assembly 40 includes at least two flexible support members 30, wherein the flexible support members 30 are disposed through an aperture of a ring 20. Each of the flexible support members 30 is constructed of a single continuous length wherein an equal length of material is disposed on either side of the ring thereby forming at least four support members 35 disposed on each side of the ring 20. As shown in FIG. 1, the support members 35 are attached to one other at portion 37, adjacent to the ring 20, thereby forming a loop about the ring 20. The support members 35 may be attached to one another using mechanical means such as riveting, stitching or similar methods or through the use of glues, heat sealing, or other similar means.

It is to be understood that although the flexible support members 30 are defined as being constructed of a single continuous length, it is contemplated and within the scope of the present invention that the flexible members may be constructed of multiple pieces of material fastened together with appropriate fastening means. Additionally, although the present invention is shown and described utilizing two continuous flexible members forming four support members it is contemplated that a fewer number of flexible members or a greater number of flexible members may be utilized in accordance with hanger of the present invention.

Ring 20 may be constructed of materials such as ferrous or non-ferrous metals, ceramics, plastics and other similar methods. Additionally, in a preferred embodiment the ring is generally circular in shape, though it is contemplated that other shapes may be substituted without departing from the scope of the invention. Ring 20 is configured to receive a fixed support, or additional hanging means such as chain, rope, metal loops, additional rings, carabineers and such.

Flexible support members 30 may be constructed of materials such as nylon strapping, nylon rope, nylon webbing, cotton rope, cotton webbing, leather, textiles, metal webbing or rope, or other similar materials.

Figure 2:
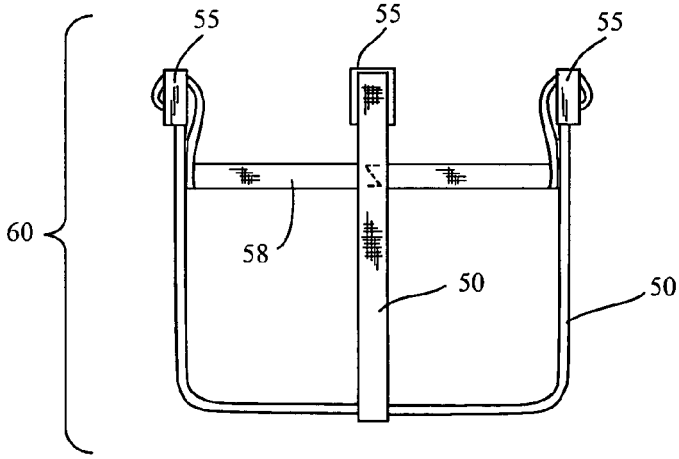
FIG. 2 is a perspective view of an exemplary embodiment of the lower assembly of the hanger in accordance with the present invention.

Referring now to FIG. 2, there is shown an exemplary embodiment of the lower assembly 60 forming a cradle in accordance with the present invention. As shown in FIG. 2, the lower assembly 60 is configured to retain objects such as a plant container, shown in dotted outline, and includes a plurality of flexible members 50 having first and second ends, wherein connectors 55 are disposed on each of the ends of the flexible members respectively. The connectors 55 are configured to slidably receive the distal ends 31 of the flexible support members 30 of the upper assembly 40. The connectors are configured to frictionally retain the distal ends 31 of the flexible support members 30 of the upper assembly 40. Though it is contemplated that the connectors may utilize other retention means such as clamping force, puncturing devices and the like to retain the flexible support members 30 therein. An example of a suitable connector is commonly referred to in the industry as a "ladder lock", another example of a suitable connector is commonly referred to as a "tri-glide". Each of these connectors retain material such as nylon webbing by passing the webbing through a series of slots formed in the connector, wherein the friction between the webbing and the slot opening act to retain the webbing in a fixed position. A benefit of utilizing connectors of these types is that the distance between the ring 20 and the lower assembly 60 may be adjusted easily, thereby allowing a user to custom tailor the length of the entire assembly for various size plants or objects retained in the lower assembly 60.

Figure 3:
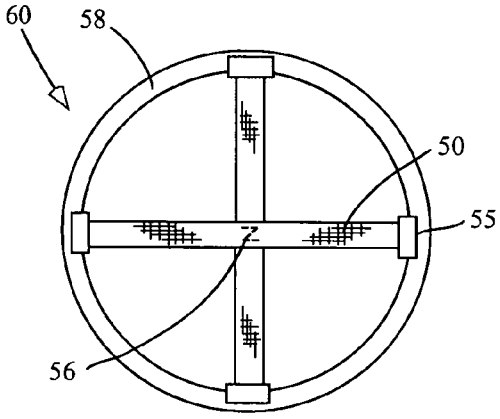
FIG. 3 is a top view of the lower assembly as shown in FIG. 2.
Figure 4:
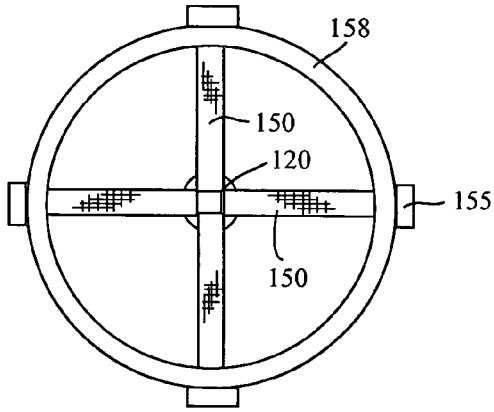
FIG. 4 is a top view of an alternative embodiment of the lower assembly of the hanger in accordance with the present invention.

Referring now to FIG. 3, there is shown a top view of the lower assembly 60. As shown in FIG. 3, each of the flexible members 50 are connected to one another about a mid point 56. The flexible members may be connected to one another through the use of mechanical means such as stitching, riveting, glues, heating, or other similar means. Referring now to FIG. 4, there is shown an alternative embodiment of the lower assembly 60 in accordance with the present invention. As shown in FIG. 4, the lower assembly includes a plurality of flexible members 150, wherein each flexible member has first and second ends. A connector 155 is disposed at each of the first ends of the flexible members 150 and the second ends are disposed through an aperture of a ring 122 and doubled back along the length of each flexible member and fastened to form a loop thereby retaining the ring 120 in about a center point of the assembly.

As shown in FIGS. 1–4, the lower assembly 60, further includes a retaining member 58, wherein the retaining member 58 may be either fixedly attached to each flexible member 50 adjacent to the connectors 55. The retaining member 58 maintains equal spacing between each of the flexible members 50, wherein the ends of each flexible member are retained relative to one another. In use, the retaining member 58 restricts the independent movement of each of the flexible members 50, wherein in a situation where an external force is applied to an object retained within the lower assembly 60 the flexible members 50 will not deflect independently, thus the object will remain retained within the lower assembly.

The retaining member 58 may be constructed of the same or similar materials as that of the flexible members 50. It is further contemplated that the retaining member 58 may include an adjustment means configured to adjust the length/diameter of the retaining member 58. The adjustment means could comprise a connector such as those described in detail above and indicated by reference number 55. Alternatively, the adjustment means may comprise a buckle assembly or other similar mechanical devices that may be utilized to adjust the length/diameter of the retaining member 58.

Figure 5:
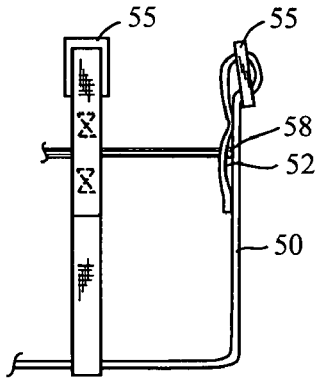
FIG. 5 is a partial side view of a lower assembly of the hanger in accordance with the present invention.

Referring now to FIG. 5, it is contemplated that the adjustment member 58 may be constructed of a flexible material such as elastic cord or incorporate flexible materials such as elastic cord, wherein the retaining member 58 would be capable of expanding or contracting automatically to retain objects of various sizes and shapes. If the retaining member is constructed of a flexible material such as that described above, in a preferred embodiment, each of the flexible members 50 would include a loop or other means adapted to slidably receive the retaining member 58 as shown in FIG. 5. In this embodiment, the retaining member would be capable of moving independent of each of the flexible members 50, thereby enabling the hanger to accommodate objects of various shapes and sizes. As shown in FIG. 5, the loops 52 may be formed by doubling the flexible member 50 over and fixedly attaching the end of the flexible member along it's length as shown, thereby forming a pocket 52. The pocket 52 being configured to receive the retaining member 58.

Figure 6:
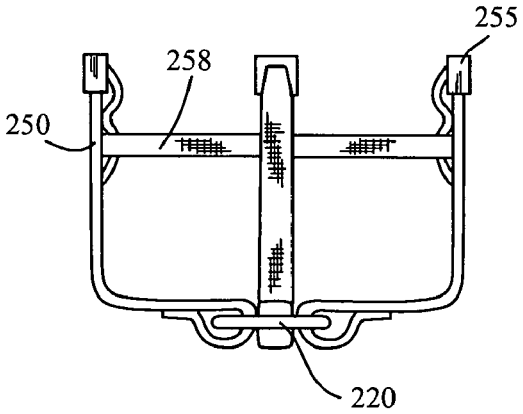
FIG. 6 is a size view of an alternative embodiment of the lower assembly of the hanger in accordance with the present invention.
Figure 7:
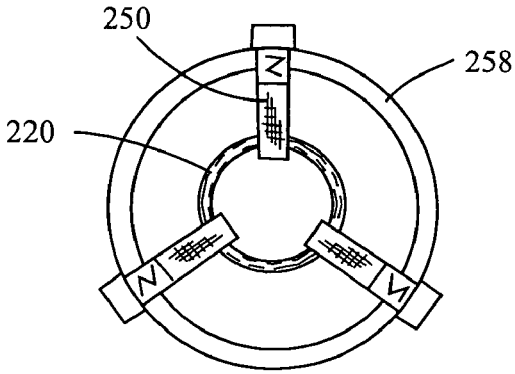
FIG. 7 is a top view of the lower assembly shown in FIG. 6.

Referring now to FIGS. 6 and 7 there is shown an alternative embodiment of the lower assembly in accordance with the present invention. As shown in FIGS. 6 and 7, the lower assembly 260 comprises a plurality of flexible members 250 each having first and second ends, wherein a connector is disposed about the first end and the second end is configured to retain a ring 220. As shown, each of the flexible members 250 are equally spaced from one another, wherein the spacing of each of the flexible members being retained by retaining member 258.

Figure 8:
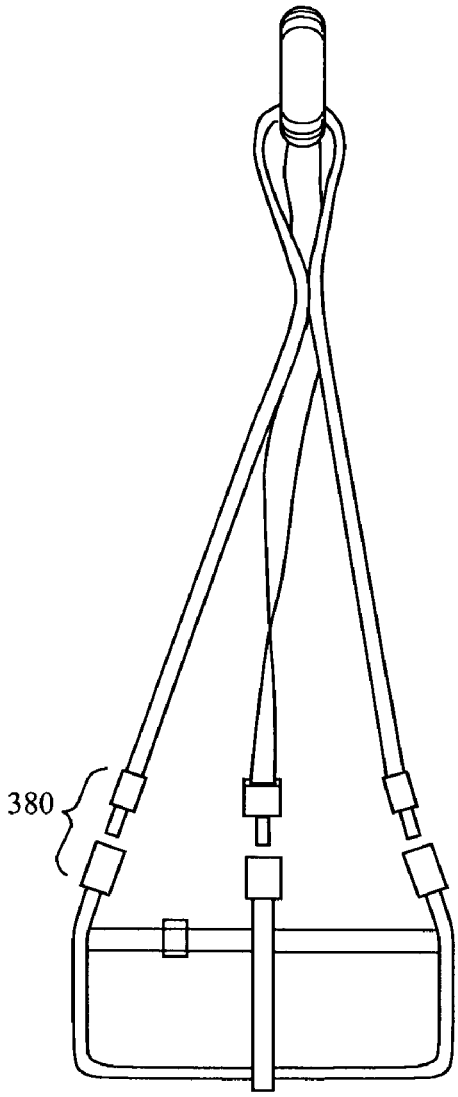
FIG. 8 is a side view of an alternative embodiment of the hanger assembly illustrating a detachable lower assembly.

Referring now to FIG. 8, there is shown yet another alternative embodiment of the hanger in accordance with the present invention. As shown in FIG. 8, the hanger 300 comprises an upper assembly 340 and a lower assembly 360, wherein each of the assemblies are similar to those described in detail above, wherein the upper and lower assemblies are further include buckle means 380. Buckle means 380 comprises an upper buckle assembly 382 and a lower assembly 384, wherein the lower buckle assembly is configured to detachably receive the upper buckle assembly. Through the utilization of the buckle assemblies, the upper and lower portions of the hanger may be quickly separated from each other. By providing releasable buckle assemblies, a potted plant retained in the lower assembly 360 may be easily removed from the hanger for maintenance such as trimming or watering. Additionally, one lower assembly may be removed and a different lower assembly may be attached to the hanger assembly. It may be desirable to change the lower assemblies for aesthetic reasons, maintenance reasons, or to change the configuration of the hanger assembly. Such that a lower assembly retaining a plant may be substituted for a lower assembly retaining a audio loudspeaker.

Figure 9:
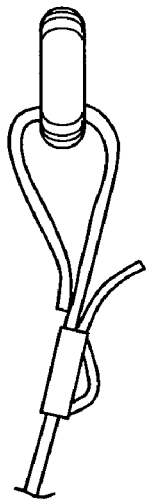
FIG. 9 is a partial size view of an alternative embodiment of an upper flexible member of the hanger in accordance with the present invention.

Referring now to FIG. 9, there is shown an alternative embodiment of the upper flexible members in accordance with the present invention. As show in FIG. 9, the upper flexible members may be constructed of multiple pieces, wherein the length of each of the flexible members may be adjustable. As shown, the flexible members include a portion 451 disposed through a ring 420, wherein a connector is disposed on the distal end of the portion 451. The connector being configured to receive and retain a second portion 452 of the flexible member, wherein the first portion, second portion and connector comprise the flexible member 450. By utilizing length adjustment means on the upper flexible members, the upper and lower assemblies may be combined as a single unit. Alternatively, the adjustable length upper flexible members may be used in combination with any of the embodiments shown in FIGS. 1–8.

Although the hanger of the present invention has been shown and described as being configured to retain items such as potted plants it is contemplated that the hanger could be utilized to retain other items. Such items could be but not limited to: coolers, fish bowls, audio speakers, audio components, televisions, monitors, light fixtures. It is contemplated that modifications may be made to the lower assembly of the hanger to retain items of this type without departing from the scope of the present invention.

As various changes could be made in the above constructions without departing from the scope of the invention, it is intended to that all matter contained in the above description or shown in the accompanying drawings shall be interpreted as illustrative and not in a limiting sense.

The instant invention is shown and described herein in what is considered to be the most practical, and preferred embodiments. It is recognized, however, that departures may be made there from, which are within the scope of the invention, and that obvious modifications will occur to one skilled in the art upon reading this disclosure.

I claim:

1. A hanger adapted for retaining and hanging objects, the hanger comprising:

a ring;

at least two upper flexible members having first and second ends, wherein each member is received through an aperture of said ring and each upper flexible member permanently connected to each other respectively at a distance spaced apart from said ring, said flexible members defining an upper portion of said hanger;

a lower hanger portion, said lower hanger portion including of at least two lower flexible members having first and second ends, wherein each of the two members are permanently connected to each other at a mid point, the first and second ends including an adjustment means configured to receive said second ends of said upper flexible members; and a flexible retaining ring, said flexible retaining ring directly coupled to said first and second ends of said lower flexible members, wherein said retaining ring is configured to retain said ends of said lower flexible members at a distance spaced apart from one another.

2. The hanger according to claim 1, wherein said upper flexible members are nylon.

3. The hanger according to claim 2, wherein said lower flexible members are nylon.

4. The hanger according to claim 3, wherein said flexible retaining ring has an adjustable length.

5. The hanger according to claim 1, wherein the upper and lower flexible members are cylindrical in cross-section.

6. The hanger according to claim 1, wherein said ring is constructed of a material chosen from the group consisting of: steel, stainless steel, titanium, ceramic, plastic.

7. The hanger according to claim 1, wherein the lower hanger portion is configured to retain a plant container.

8. The hanger according to claim 1, wherein the lower hanger portion is configured to retain an audio loudspeaker.

9. The hanger according to claim 1, wherein said adjustment means includes a buckle.

10. A hanger for suspending a plant container and the like from a fixed support, said hanger comprising:

a first ring;

an upper portion, said upper portion including at least two flexible upper members having first and second ends defining a length, wherein the flexible members are disposed through an aperture of said ring wherein equal lengths of said members are disposed on each side of said ring, wherein each flexible member permanently connected to each other respectively at a distance spaced apart from said ring; and a container supporting member, said container supporting member including at least two flexible members having first and second ends, each permanently connected to one another about a midpoint and including connection means at each end, wherein said connection means are adapted to receive said first and second end of said upper members, said container supporting member further including a third flexible support member, wherein said third flexible member is directly coupled to and adjacent to the first and second ends of said flexible members comprising said container supporting member.

11. The hanger according to claim 10, wherein said flexible upper members further include means configured to adjust said length of said members disposed through said aperture of said ring.

12. The hanger according to claim 11, wherein said upper flexible member are constructed of a material chosen from the group consisting of: nylon webbing, cotton webbing, leather, plastic webbing, nylon rope, cotton rope, steel rope, steel webbing, chain and textile.

13. The hanger according to claim 12, wherein said flexible members of container support member are constructed of a material chosen from the group consisting of: nylon webbing, cotton webbing, leather, plastic webbing, nylon rope, cotton rope, steel rope, steel webbing, chain and textile.

14. The hanger according to claim 10, wherein said third flexible member forms a generally cylindrical shaped member.

15. The hanger according to claim 14, wherein said third flexible member further includes a length adjustment member.

16. The hanger according to claim 10, wherein said container supporting member includes a third flexible member, wherein the flexible members have a first and second end, the first end having a connector adapted to receive the ends of the upper flexible members and the second ends coupled to a second ring.

17. The hanger according to claim 16, wherein the first ring is constructed of a material selected from the group consisting of: ferrous metals, non-ferrous metals, plastics, composites and ceramics.

18. The hanger according to claim 10, further including an insulated cooler disposed within the container supporting member.

19. The hanger according to claim 10, wherein the ends of the upper flexible members include a buckle portion disposed thereon and the container support member further includes a buckle portion disposed on the ends of the flexible members thereon, wherein each of the buckle portions are configured to detachably receive one another.

* * * * *